US006223502B1

(12) United States Patent
Cress et al.

(10) Patent No.: US 6,223,502 B1
(45) **Date of Patent: *May 1, 2001**

(54) METHOD AND APPARATUS FOR WASHING WARES FOR FOOD AND FILLING WARES WITH FOOD

(75) Inventors: Fred W. Cress; Peter R. Simon, both of Mississauga; Anthony G. DiMarco, Woodbridge; Luigi J. Priolo, Etobicoke; Peter J. Clarke, Richmond Hill; Darcy J. Hawkins, Brampton, all of (CA)

(73) Assignee: Cara Operations Limited, Toronto (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/049,082

(22) Filed: Mar. 27, 1998

(30) Foreign Application Priority Data

Mar. 26, 1998 (CA) ..... 2233404

(51) Int. Cl.[7] ..... B65B 55/04

(52) U.S. Cl. ..... 53/426; 53/167; 134/25.2; 134/58 D

(58) Field of Search ..... 53/426, 167, 431; 134/25.2, 48, 56 D, 58 D

(56) References Cited

U.S. PATENT DOCUMENTS

| | | | | |
|---|---|---|---|---|
| 3,058,276 | * | 10/1962 | Palma | 53/167 |
| 3,122,235 | | 2/1964 | Meeker et al. . | |
| 3,960,290 | | 6/1976 | Yake et al. . | |
| 4,349,508 | * | 9/1982 | Liede | 53/426 |
| 5,201,826 | | 4/1993 | Zimmermann . | |
| 5,377,475 | * | 1/1995 | Haarer et al. | 53/167 |

FOREIGN PATENT DOCUMENTS

| | | |
|---|---|---|
| WO 96/01584 | 1/1996 | (WO) . |
| WO 98/04180 | 2/1998 | (WO) . |

OTHER PUBLICATIONS

"Eastern Airlines Dedicates New Altanta Flight Kitchen", pp. 1–2, dated Dec. 14,1988.

* cited by examiner

*Primary Examiner*—Stephen F. Gerrity
(74) *Attorney, Agent, or Firm*—Bereskin & Parr

(57) ABSTRACT

A method and apparatus are provided for cleaning and refilling wares for delivering food, e.g. trays, plates, bowls and cutlery, as might be used on airlines and in the health care industry. The wares are provided in sets and kept together in sets. After washing of each set, it is cooled if necessary and immediately refilled, for reuse. This can be achieved by providing a conveyor line along which are arranged a washer, dryer and cooling unit to keep the wares together. The invention provides a basket, configured to hold a number of sets of wares, the exact number depending upon the types of wares.

16 Claims, 11 Drawing Sheets

METHOD AND APPARATUS FOR WASHING WARES FOR FOOD AND FILLING WARES WITH FOOD

FIELD OF THE INVENTION

This invention relates to an apparatus and a method for cleaning soiled food containers, utensils, trays etc., and for enabling a tray to be assembled with a required complement of wares, e.g. bowls or other food containers and utensils and filling the containers with food. This invention has applicability in any large institution or organization including airlines, hospitals, other health care institutions and the like.

BACKGROUND OF THE INVENTION

It has long been known to provide meals for aircraft passengers, by preparing the food in a ground facility or kitchen, and, for each passenger, assembling a tray comprising the necessary bowls, plates, utensils with the food already placed in the bowls etc. This is done for the simple reason that the compact space and weight limitations of aircraft simply do not permit of anything beyond simple reheating and serving of food. Accordingly, much expertise has been developed in promptly assembling meals in this manner, even in relatively large quantities, and arranging for their delivery immediately prior to the departure of flight, to ensure that the food is relatively fresh.

Many large institutions have also had a requirement to prepare meals or food in large quantities, and arrange, in effect, for each meal to be delivered individually to a person. This commonly arises in hospitals and institutions caring for elderly people. Traditionally, such institutions would have a kitchen on site, and the meals would be prepared, and delivered from the kitchen immediately by a trolley or cart to the patients.

More recently, for such institutions, it has been recognized that there are advantages to preparing meals or food in a more systematic way, possibly even using an external facility, so that the food is then prepared and delivered in a manner analogous to the preparation and delivery of airline meals. Equipment has been developed which enables trays to be loaded with some food which is to be served warm, e.g. a traditional hot meal, and other items, e.g. dairy products, which are to be kept cold. Such trays are provided with a central divider, separating the tray into two halves. Such trays are then loaded into a special container or cart which is provided with ducting, so that one side of each tray can be chilled with cold air, and immediately prior to handing out the trays to the individuals, the other side of each tray has warm or hot air passed over it to reheat or rethermalize the food on that side.

However, a fundamental problem with any such technique is the handling of the wares, and in this specification including the claims, the term "wares" encompasses trays, plates, bowls, cups, utensils and any other reusable items necessary to deliver food and beverage. There is the problem of assembling the wares to make up complete or loaded trays and the handling of soiled, returned wares. The traditional approach, used by flight kitchens for airlines and the like is to treat the two operations of cleaning soiled wares and preparing fresh trays as entirely separate.

Thus, a conventional kitchen, for preparing of airline meals, soiled trays etc., are commonly received in standard carts. These are unloaded, and the individual wares, i.e. trays, bowls, cups, knives and forks are separated and placed on a conveyor, which takes them through a large washing and drying unit, where the wares are washed and dried. At the exit from this unit, the individual items are collected, stacked and placed in separate storage. Usually, the wares are quite warm as a result of the washing and drying process, but this is not a disadvantage where the wares are placed in storage, and indeed there may even be benefits in driving off any remaining moisture.

Here, it should be born in mind that each airline usually has their own line of crockery or utensils, bearing the airline's insignia. Consequently in these kitchens, there is the need to handle a wide variety of different bowls, plates and other wares, and to keep these separate. Also, even for any one airline, there is usually a difference between the wares used for tourists or ordinary class passengers and that used in business or first class, which again increases the number of different types of wares that have to be stored and handled. Thus, it is common for a flight kitchen to have a relatively large storage area where all of the different types of wares etc. are stored.

When it is desired to prepare food for a particular flight, the appropriate trays, crockery and other wares are pulled from storage, and delivered to a separate section of the flight kitchen. There, individual trays are made up, commonly comprising a tray, a number of bowls, cups, cutlery and condiments. The cutlery may either be reusable, commonly stainless steel cutlery or disposable plastic cutlery. In either case, it is common for the necessary items of cutlery to be separately packaged, often with individual packets of condiments and the like, or enclosed in a plastic bag. As a matter of convenience in assembling the tray, the bag containing these various items is often placed on the tray at the end of the assembly process. The tray with the bowls is passed along a conveyor belt or line, and the individual food items are placed on it sequentially, both to enable the trays to be assembled quickly, and to ensure consistency and uniformity.

Depending upon the exact timing, the completed trays may be dispatched immediately from delivery to an aircraft, or alternatively may be held in a large, refrigerated storage facility. It should also be born in mind that passengers often have requirements for specific meals, to meet dietary requirements, religious laws and the like. These, usually, must be prepared individually, and then stored with the main part of the shipment, for delivery to the individual aircraft.

Generally similar techniques are used, when preparing food for hospitals and other institutions. The main difference is that, for airline use, the trays, bowls etc. are often quite compact, and airline passengers recognize and accept that compact equipment has to be used in the confined space of an aircraft. On the other hand, wares for use in hospitals and the like are usually of more conventional dimensions, so as to be significantly larger than those found on aircraft. This, in turn, creates complexity if a kitchen is to be configured to handle all types of wares. As noted, it is also becoming more common, for such institutional use, to provide trays, which often will be much larger than airline trays, with a central divider separating the tray into two parts, to enable both hot and cold food to be delivered simultaneously.

SUMMARY OF THE INVENTION

Accordingly, the inventor of the present invention has recognized that it is desirable to provide a more streamlined and efficient way of handling these wares. More particularly, the present inventor has realized that it is desirable to eliminate the storage of cleaned crockery etc. and, in effect, to provide immediate turnaround or reuse of the equipment once it has been cleaned. This then avoids the problem of sorting and storing different types of wares and subsequently locating and retrieving appropriate equipment for an individual flight.

In accordance with a first aspect of the present invention, there is provided a method of washing wares for food and filling the wares with food, the method comprising:

(1) receiving sets of soiled wares, each set comprising a plurality of wares intended to be used together for one individual;

(2) passing the wares through a washing and drying means, in which the wares are washed and dried;

(3) cooling the wares down to a temperature low enough to permit immediate refilling of the wares with food; and (4) reassembling the wares into sets and refilling the wares with food, whereby each set is ready for delivery to an individual;

wherein steps (2), (3) and (4) are carried out substantially continuously and sequentially.

Preferably, in steps (2) and (3) the wares are kept together in sets. Commonly, each set of wares will comprise a tray and other wares carried by the tray.

The method can be carried out by placing the wares directly onto a conveyor. However, in a preferred aspect of the present invention, the method is carried out using a plurality of baskets, each of which is intended to hold at least one complete set of wares, wherein step (1) includes loading each set of wares into a basket, steps (2) and (3) comprise sequentially passing the baskets loaded with sets of wares through a washing and drying means and through a cooling means, and step (4) comprises removing each set of wares from the baskets and returning the baskets for reuse.

Depending on the wares, each basket can be adapted to hold two or four sets of wares. Then, in step (1) two or four sets of wares, as required, are loaded into each basket and, in step (4), all the sets of wares are unloaded from each basket.

The method is advantageously carried out by providing a substantially continuous conveyor means, including an input station at one point on the conveyor means and a discharge station at another point on the conveyor means, the washing and drying means and the cooling means being provided along the conveyor means, wherein step (1) comprises receiving sets of soiled wares at the input station, loading soiled wares into baskets at the input station and loading the baskets with the soiled wares onto the conveyor means, whereby the baskets are transported by the conveyor means through the washing and drying means and then through the cooling means, and wherein step (4) comprises receiving the baskets at the discharge station and removing and reassembling the sets of wares from the baskets and then returning the baskets along the conveyor means to the input station.

In accordance with another aspect of the present invention, there is provided an apparatus for washing soiled wares and providing the wares ready for refilling and reuse, the apparatus comprising:

an input station for receiving soiled wares;

a discharge station for removing clean wares and reassembling wares into sets of wares;

a substantially continuous conveyor means extending between the input station and the discharge station and back from the discharge station to the input station;

a washing and drying means provided on the conveyor means; and a cooling means provided on the conveyor means, the arrangement being such that baskets containing sets of wares are sequentially subject to washing, drying and cooling between the input and discharge stations.

Advantageously, the washing and drying means comprises a separate washing unit and a separate drying unit. To enable greater throughput, the input station preferably comprises two input locations on either side of a conveyor.

As mentioned, the invention can be carried out by placing the wares directly onto a conveyor. However, it is preferred to handle the wares in sets in baskets, and in this case the conveyor means is then adapted to convey baskets, each holding at least one set of wares, wherein the baskets and the conveyor means are adapted to permit free flow of water for washing and air for drying.

A further aspect of the present invention provides a basket for conveying at least one set of wares comprising a tray, and containers for food, the basket having a generally open structure to permit free flow of water and air and the basket comprising:

a base adapted for supporting the basket on a conveying means;

a compartment for holding the tray of each set; and a compartment for holding each food container, the arrangement being such that the wares are maintained spaced apart from one another, to enable the wares to be washed and dried.

Preferably, the basket includes a retention means for holding lighter food containers in position. More preferably, the basket is adapted for holding a plurality of sets of wares, each set of wares including a tray, the basket including a plurality of slots arranged parallel to one another, for holding the trays. Conveniently, the slots for the trays are provided adjacent one edge of the basket, and a basket additionally includes slots for larger wares, provided adjacent the slots for the trays.

Preferably, the basket includes: a first area for food containers to be placed in an inverted position, to ensure draining of the food containers; first retention means for retaining the food containers in position in the first area; a second area for holding lids for food containers; and a second retention means, for ensuring the lids are retained in position in the second area. The basket can also include a portion not covered by the first retention means and the basket then includes a fixed retention member above said portion of the first area under which open containers can be placed so as to be retained in position.

Preferably, the basket also includes at least one of: an insert container for receiving cutlery; and locations for receiving tray dividers.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which.

DESCRIPTION OF THE PREFERRED EMBODIMENT

Figure 1A:
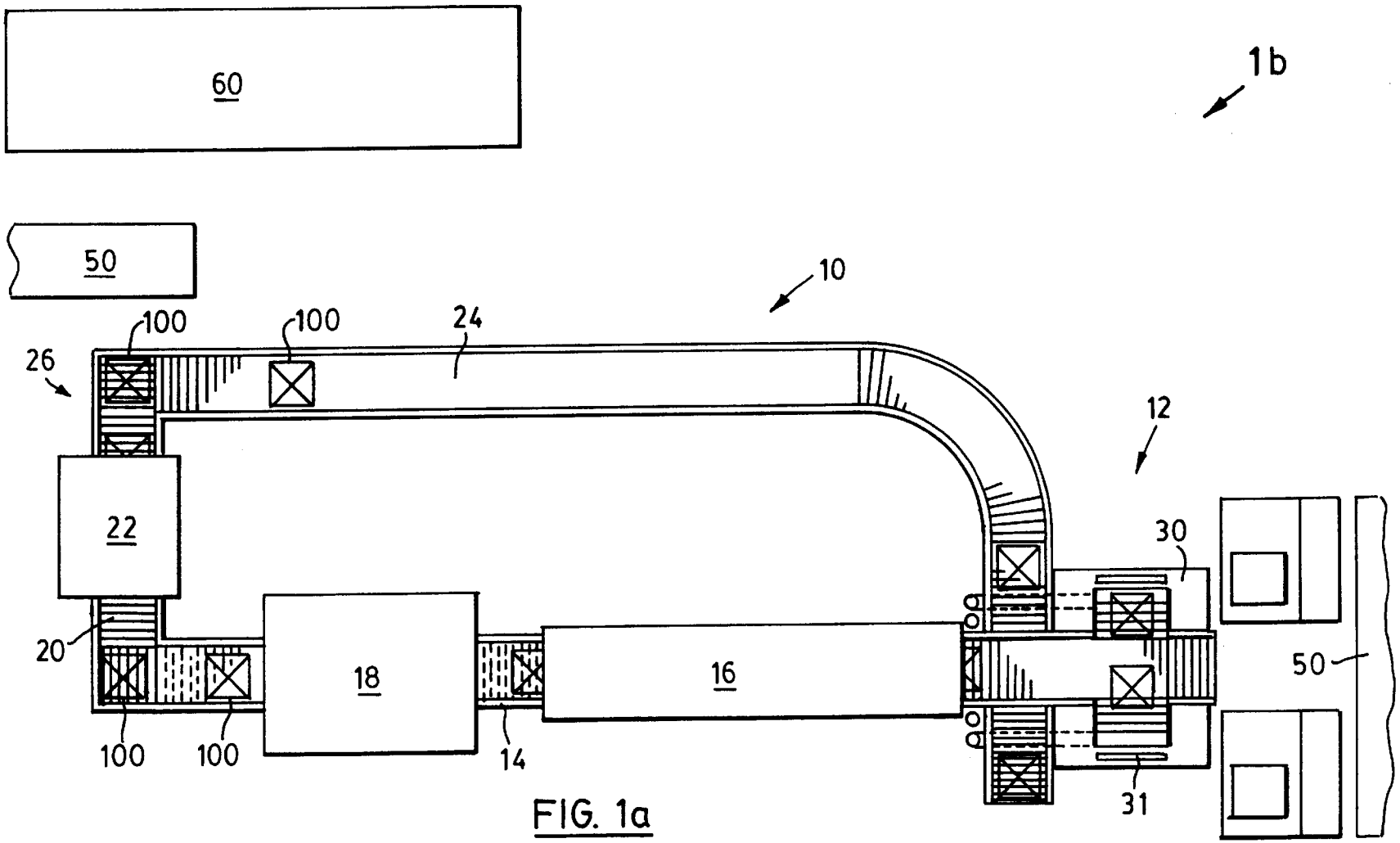
FIG. 1*a* is a plan view of an apparatus in accordance with the present invention.
Figure 1B:
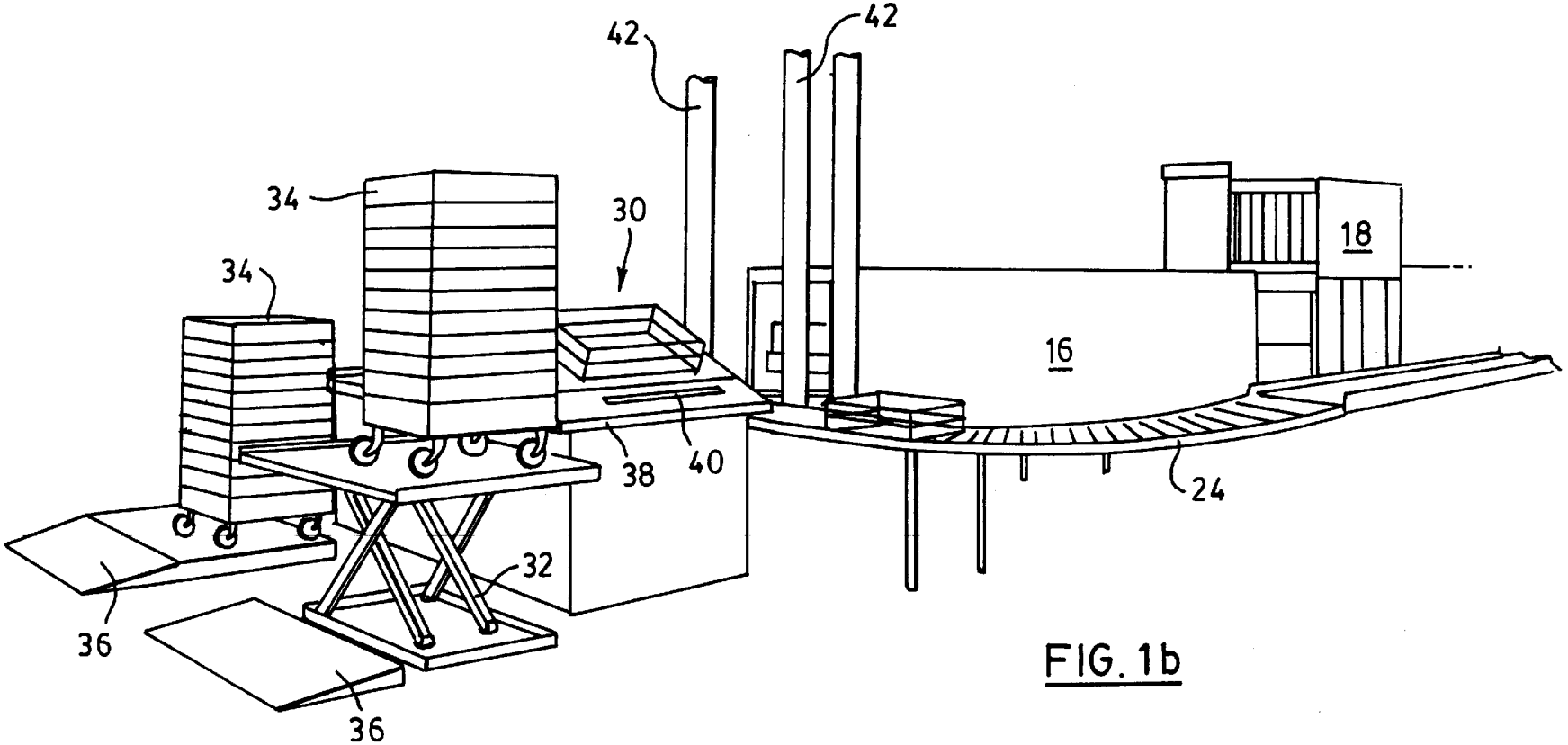
FIG. 1*b* is a perspective view, in the direction of the arrow 1*b* of FIG. 1*a*, showing an input station of the apparatus.

Referring first to FIG. 1, an apparatus in accordance with the present invention is indicated generally by the reference 10. The apparatus 10 has an input station 12. Extending from the input station 12 is a first conveyor 14, and located around and enclosing the conveyor are a washing unit 16 and a drying unit 18. At the end of the first conveyor 14, there is a second conveyor 20, and a drying unit 22 that is located on and around the second conveyor 20. A third or return conveyor 24, for purposes to be described, extends from the end of the second conveyor, back to the input station 12. A discharge station 26 is provided at the junction between the second and third conveyors 20, 24.

As indicated in FIG. 1, an incoming storage area 50 can be provided for carts or the like holding trays of sorted wares. At the discharge end, an output storage area 60 can be provided for holding trays, containing the reassembled wares after filling with food and beverage, as desired.

Figure 7:
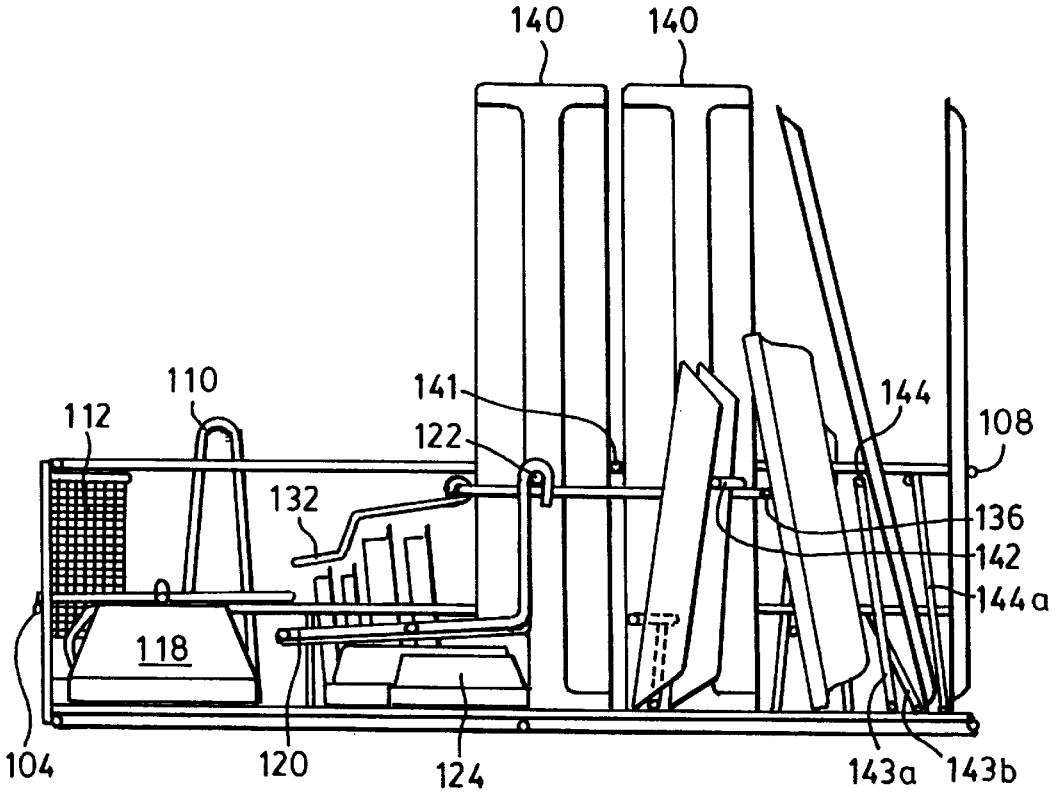
FIG. 7 is a side view of the loaded basket of FIGS. 5 and 6.

Turning to details of the input station 12, this is best seen in FIG. 7. The input station 12 has two separate locations 30 and 31, which are symmetrical about the conveyor 14, and for simplicity are described in relation to the input location 30. The provision of two input locations 30, 31 enables two operators to work simultaneously, to provide faster loading of a conveyor 14.

The input location 30 is provided with a scissors lift 32, (FIG. 1*b*) for conventional carts 34. These carts 34 can be any suitable cart with the scissors lift 32 being dimensioned accordingly. Commonly, for airline use, the carts 34 will be standard carts as found on airlines, for holding food trays and dispensing them to passengers. A ramp 36 is provided to enable the carts 34 to be rolled on top of the scissors lift 32, when in a lowered position. The lift 32 then enables an individual cart 34 to be raised to a comfortable working position, so that trays can be readily accessed.

For the location 30, an input table 38 is provided, which would be immediately in front of the operator, so that the operator would then have the lift 32 and a cart on his or her left.

The input table 38 provides an inclined surface for holding a basket 100 at an inclined angle facing the operator. The basket 100 is an important aspect of the present invention, and enables one or more complete set of wares, i.e. a tray, plates, bowls, cups, cutlery etc. to be maintained together. The basket and its mode of use is described in detail below. For the time being, it is sufficient to note that the returned, soiled wares are loaded into the basket 100, for transportation through the washing and drying unit 16 and 18 and then through the cooling unit 22.

The table 38 additionally provides a slot 40 for waste food and liquids. An operator first takes a tray out of the cart 34 and places the tray on the table 38. Waste food items and other waste, e.g. napkins, foil closures and the like are manually scraped off of the bowls and plates into the slot 40. As each bowl or plate is scraped clean, it is placed in its appropriate location in the basket 100. As detailed below, these items are not randomly placed, but the basket 100 is configured to two or more full sets of wares, in a desired pattern. Similarly, the cutlery is placed in the basket 100, as is the tray itself and any divider for the tray.

The slot 40 is part of a vacuum disposal system and is connected to suction pipes 42, so that all waste is withdrawn by vacuum to a central waste container.

Once the basket 100 has been loaded, it is placed on a conveyor 14. For this purpose, the baskets 100 can be held in an inclined position shown in FIG. 1*b* on rollers, so that they can simply be rolled up on the conveyor 14.

The conveyor 14 then conveys the baskets 100 containing the soiled wares into the washing unit 16. It is here noted that the washing and drying unit 16, 18, the cooling unit 22 and associated conveyors can, individually, be conventional items of equipment, as found in commercial or industrial scale kitchens. Thus, for each installation, appropriate washing units etc can be chosen and, depending upon the space available, appropriate conveyors or the like can be selected to connect the individual units together, to enable continuous and automatic handling of the baskets 100.

In the washing unit 16, the bowls, plates and other wares are subject to washing by high temperature, soap and water, in known manner, as followed by a rinsing step. The water is then drained from the baskets and the baskets pass into the drying unit 18, where the individual items are dried by hot air.

Conventionally, the individual utensils would be washed and dried separately. After drying, they would then be removed, while still warm, and stacked for storage. Moreover, in conventional kitchens, there is no attempt to keep utensils together in sets. In other words, all of the plates would be stored together and similarly the bowls, cutlery etc. would all be stored separately, with like items being stored together.

Here, the baskets 100 keep the equipment together in sets. Additionally, after exit from the drying unit 18, the second conveyor 20 carries the baskets 100 into a cooling unit 22. Here, chilled air cools the dried wares down. The reason for this is to enable the bowls, plates to be immediately recharged with fresh food. If they were warm, this would run the risk of promoting growth of bacteria and the like, which could cause food poisoning.

After leaving the cooling unit 22, the baskets 100 arrive at the discharge station 26. This discharge station 26 includes a separate table 50, which can be in the nature of a conveyor, or provided with rollers or the like, to facilitate movement of the trays. The detailed unloading of the trays is described below. Here, it is sufficient to note that the trays are unloaded first and then the other items removed from the basket and placed on the trays in the desired arrangement, on the loading table 50. The trays then pass down the table 50 and are recharged with food in known manner.

The empty baskets 100 are returned by the third or return conveyor 24 to the input station 12, for reloading. Additionally, this enables any items that have not been properly cleaned to be returned for a second pass through the washing unit 16. Thus, at the discharge station 26, an operator will usually keep a supply of all of the different bowls, plates, utensils, in case any are missing or dirty for any individual sets of equipment. These additional, spare items are then used to make up complete sets on the trays on the loading table 50. As noted, any soiled or improperly cleaned items are returned in the baskets along the conveyor 24.

Figure 8:
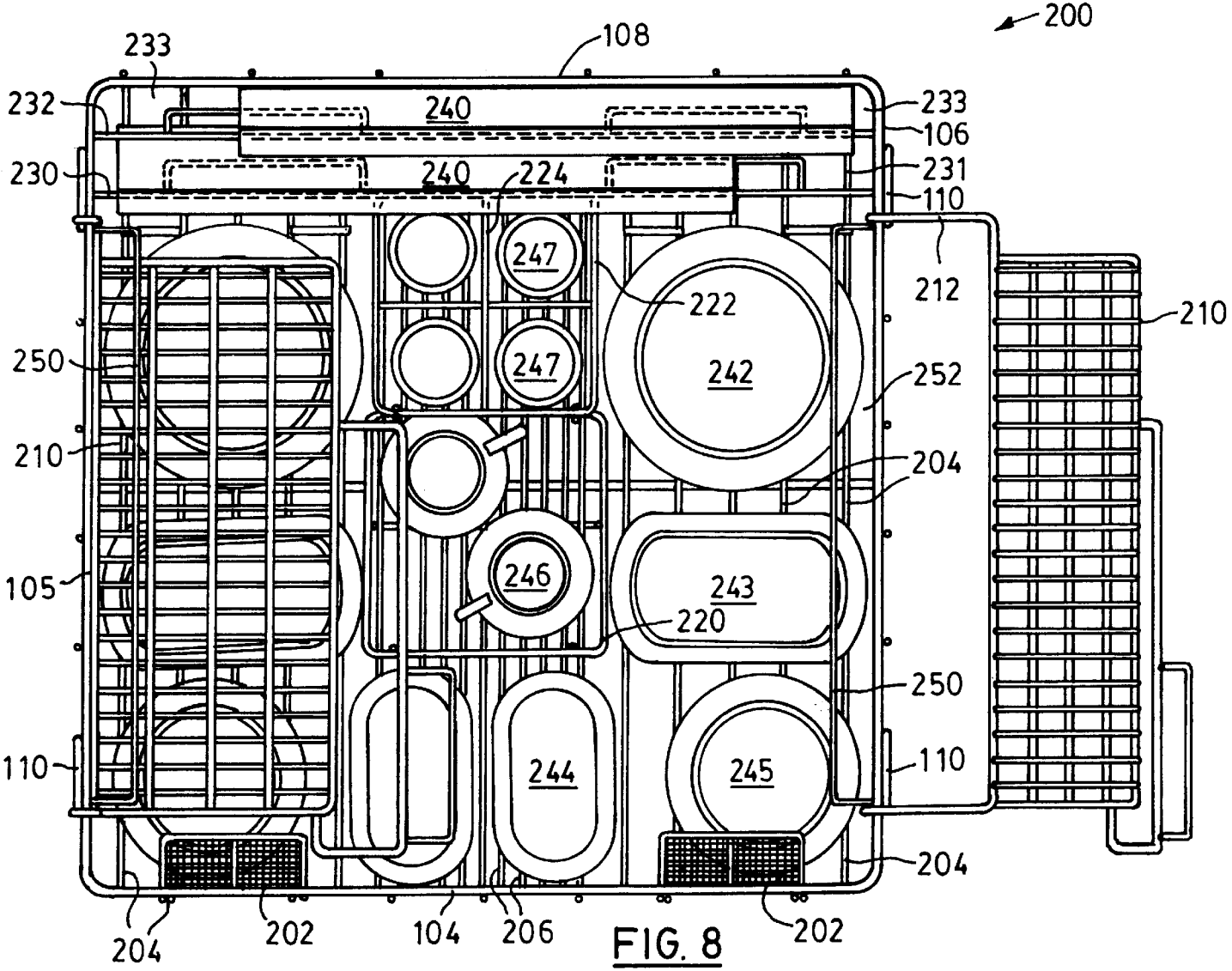
FIG. 8 is a plan view of a second embodiment of a basket according to the present invention.
Figure 9:
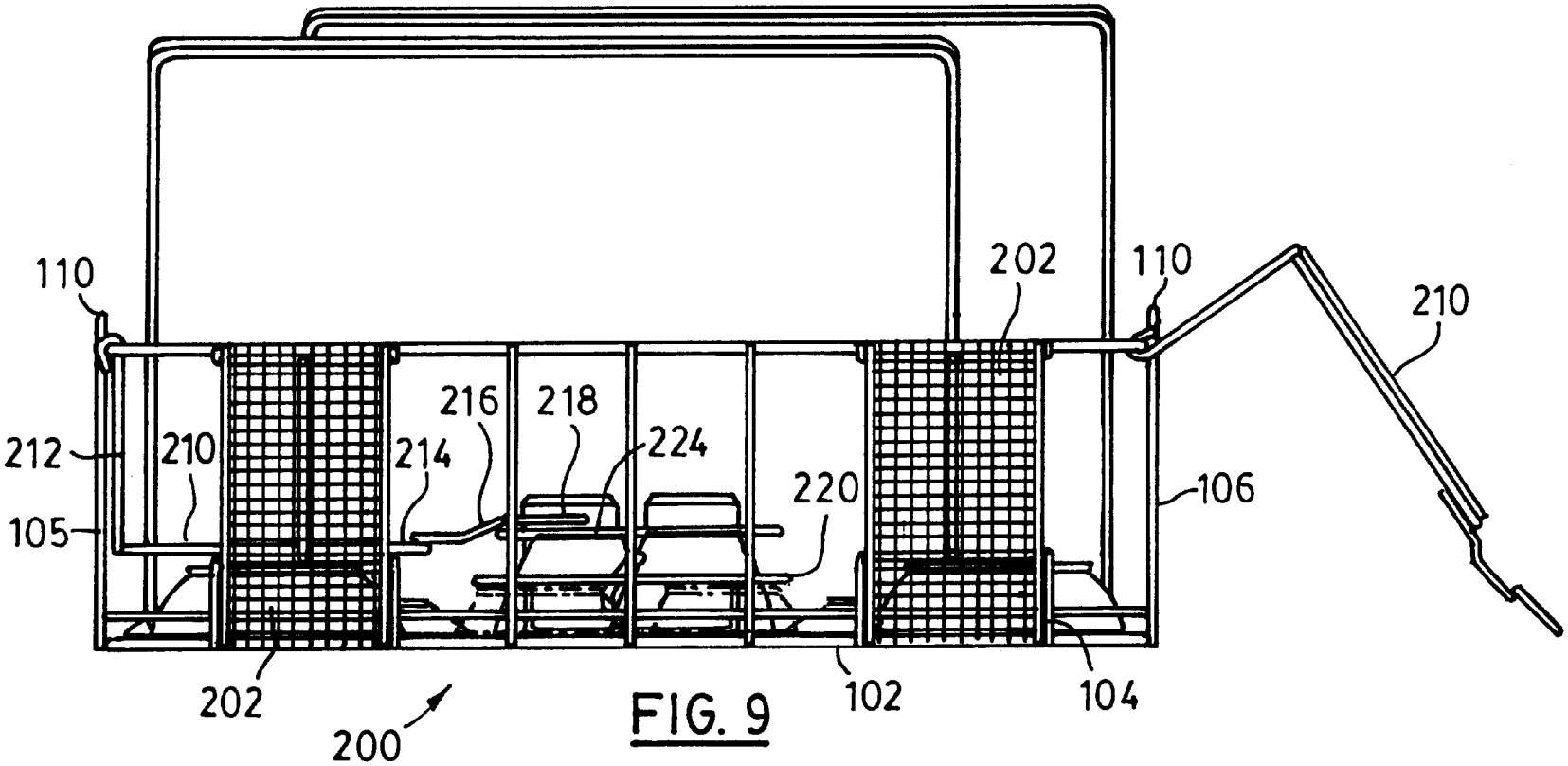
FIG. 9 is a view from the front of the second embodiment of the basket.
Figure 10:
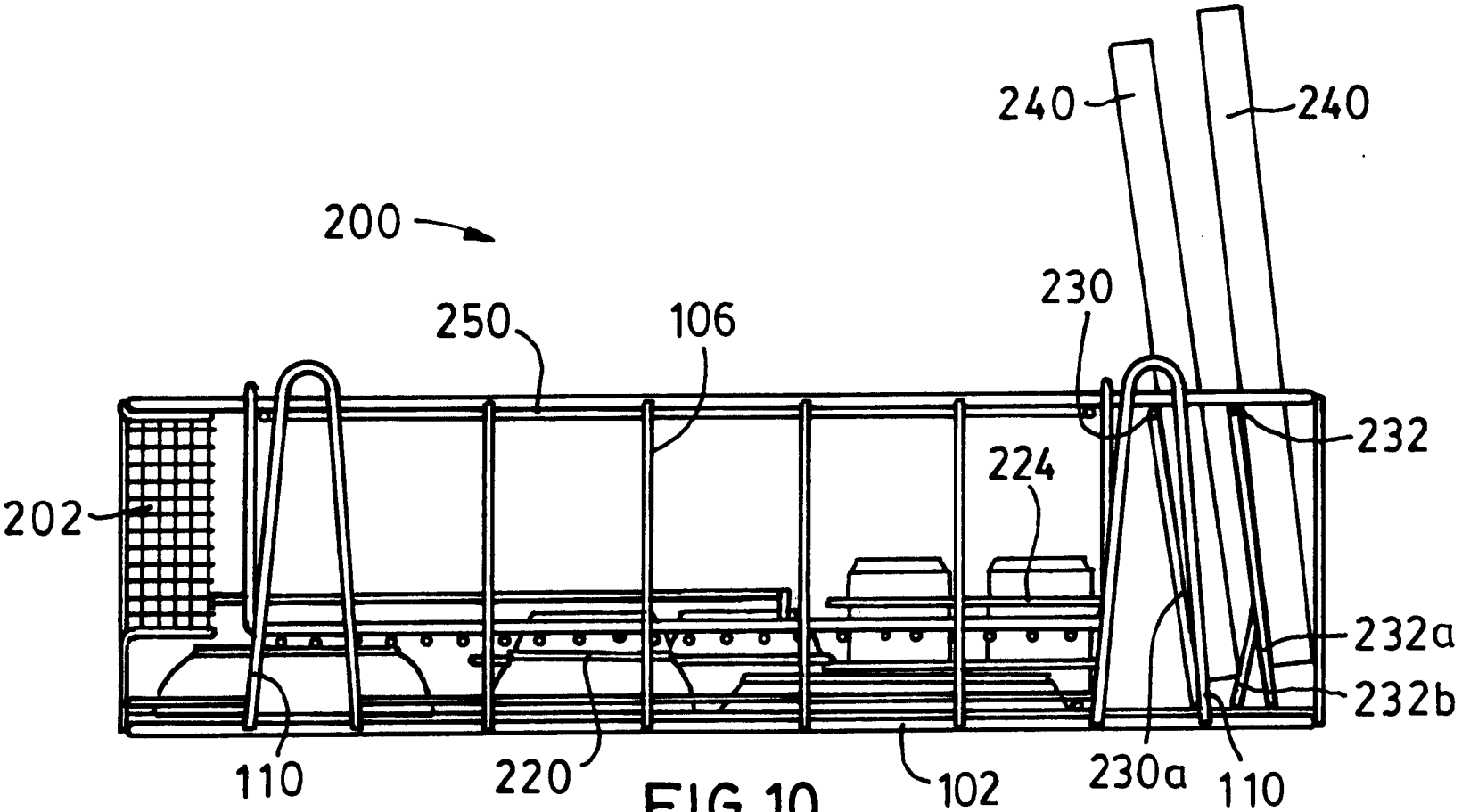
FIG. 10 is a side view of the second embodiment of the basket.

Reference will now be made to FIGS. 2–7, which show in detail a first embodiment of a basket of the present invention. The principal characteristic of this basket 100 is that it holds together a plurality of sets of wares. FIGS. 2–7 show a first embodiment of a basket, intended for holding trays and wares for use in hospitals or other health care institutions. As such, the trays and wares are relatively big and the basket 100 is intended to hold two sets. FIGS. 8–10, described below, show a basket intended for holding trays and sets of wares for airline use; it is possible that where there is a relatively small number of wares that the basket could be configured to hold four or more sets of wares.

Both embodiments of the basket are formed from wire which is bent and welded together in known manner. The completed basket is then Chrome plated. The baskets could alternatively be moulded in a suitable plastic material.

The basket 100 is generally square in plan with rectangular sides, and has a base 102, front 104 and left and right hand sides 105, 106 and a rear 108. In known manner, the base 102 is formed from a parallel array of wires extending from front to back, and secured together by various lateral or cross wires welded thereto. The various wires are all welded to one another in known manner, and chrome plated, but it will be appreciated that the basket could be formed from any suitable material, and may, for example, be molded in plastic.

As shown, the front 104, sides 105, 106 and rear 108 are formed by three wires which essentially encircle the basket and are supported above the base 102 by spaced vertical wires, to form the basic body of the basket 100. Welded to the outside of each of the sides 105, 106 is a pair of location members 110. Each location member 110 tapers inwardly slightly from top to bottom, and projects above the top of the relevant side as indicated at 111. These projecting parts 111 serve to enable the baskets to be stacked, with the projecting parts 111 engaging the sides of a basket placed above and sliding within the bottom of the location members 110 of the upper basket.

In the left hand front corner, there is a small insert container 112 of fine mesh, for holding cutlery. Surrounding this is a L-shaped wire member 114 defining a small area which can be used for various small items. At the right of this, there is a relatively large area for holding cups and bowls. A cup and bowl retaining wire 116, as shown, is shaped to retain two cups 117 having a relatively high height and two bowls 118 with a relatively low height.

Figure 2:
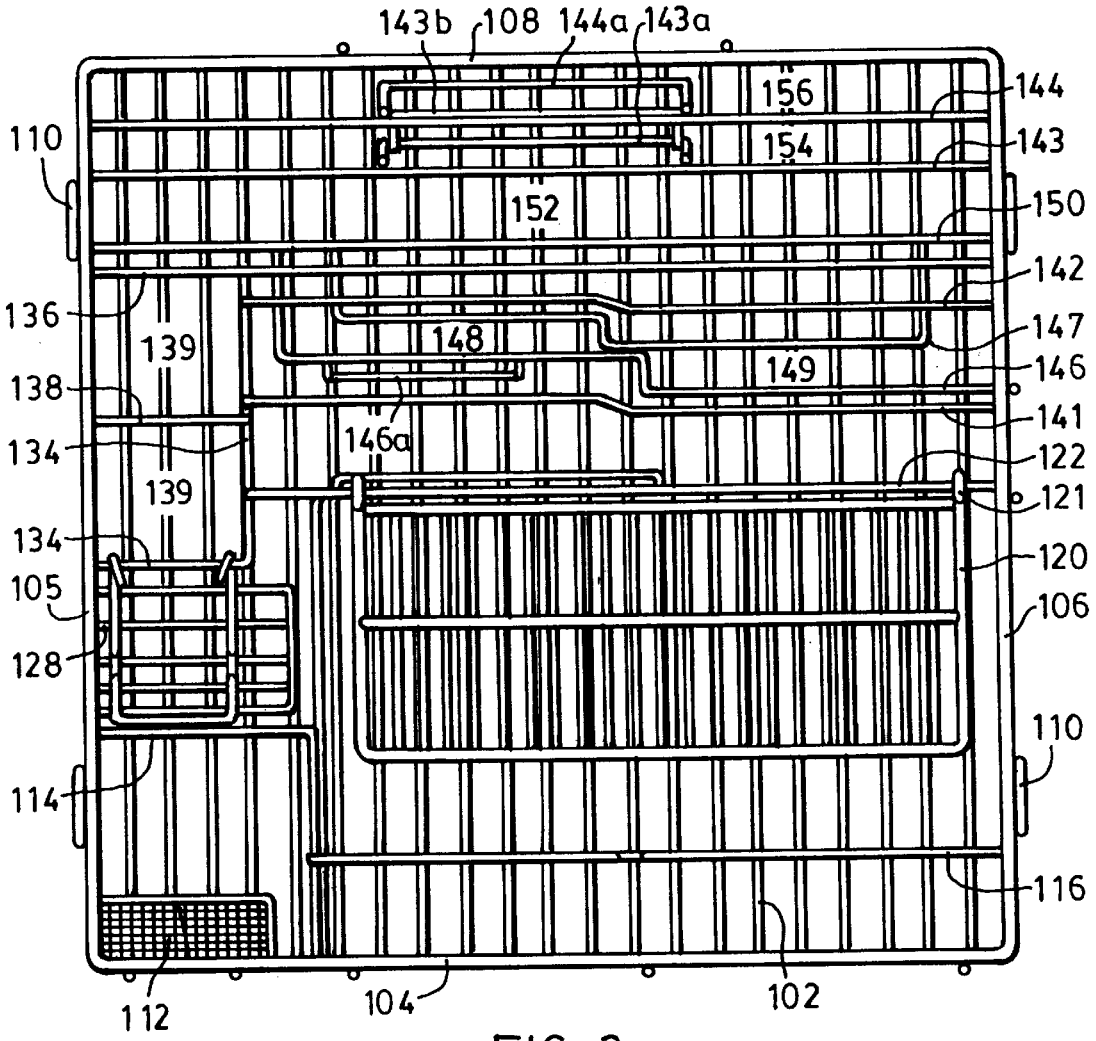
FIG. 2 is a plan view of a first embodiment of a basket for use with the apparatus of FIG. 1 in a closed configuration.
Figure 3:
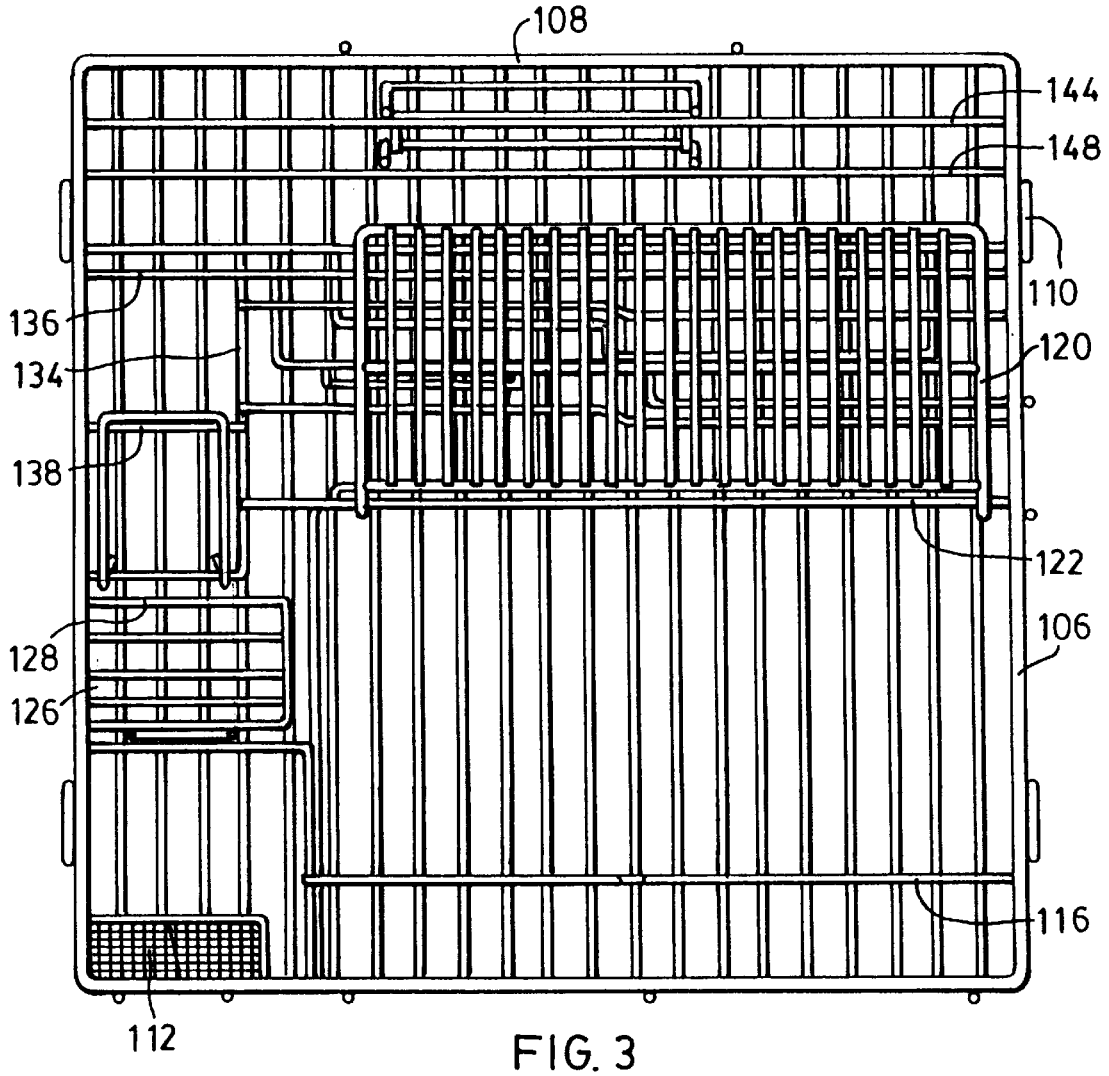
FIG. 3 is a plan view similar to FIG. 2, showing elements of the basket in an open configuration.
Figure 4:
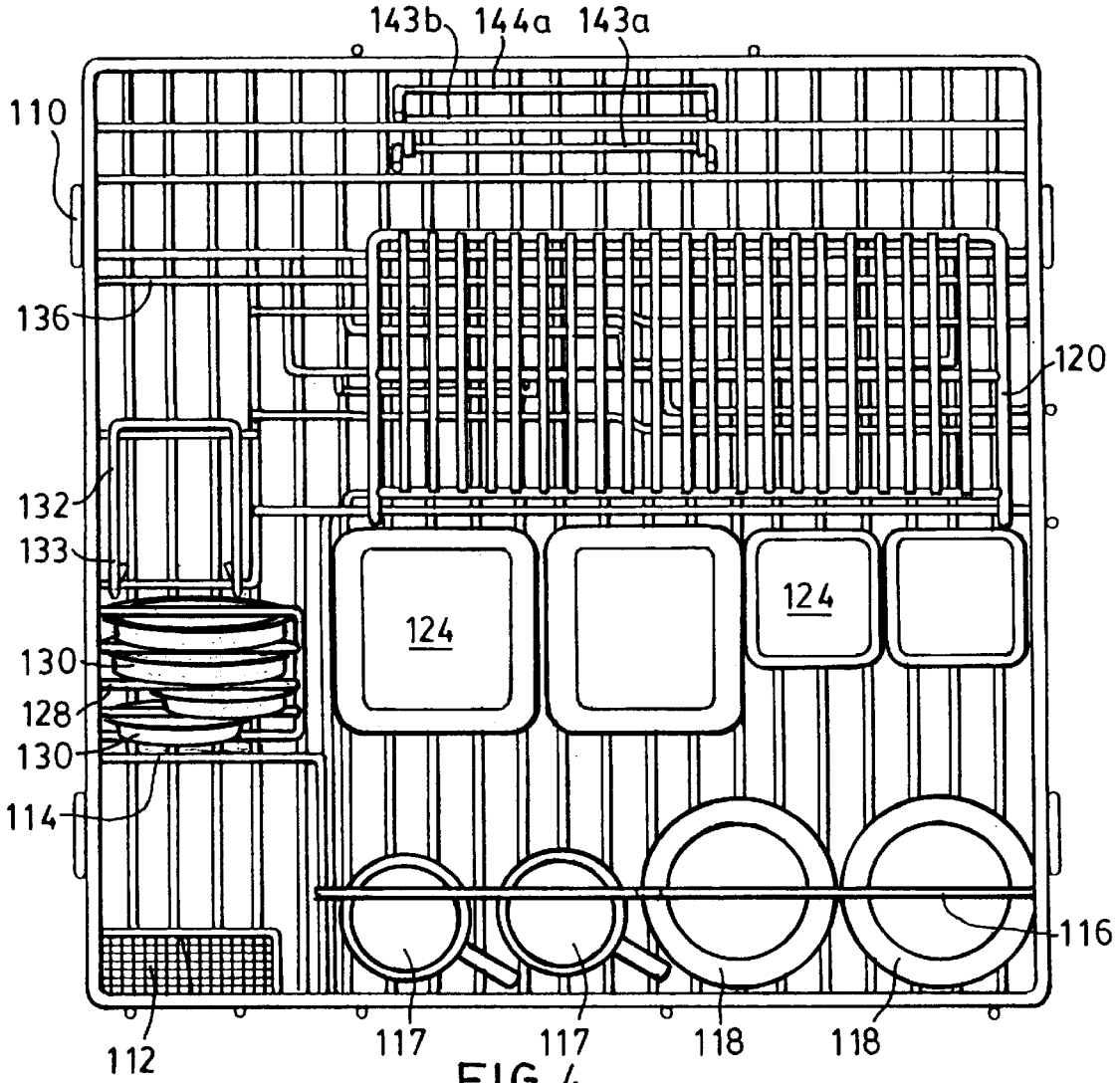
FIG. 4 is a plan view, similar to FIG. 3, showing the basket loaded with wares.
Figure 5:
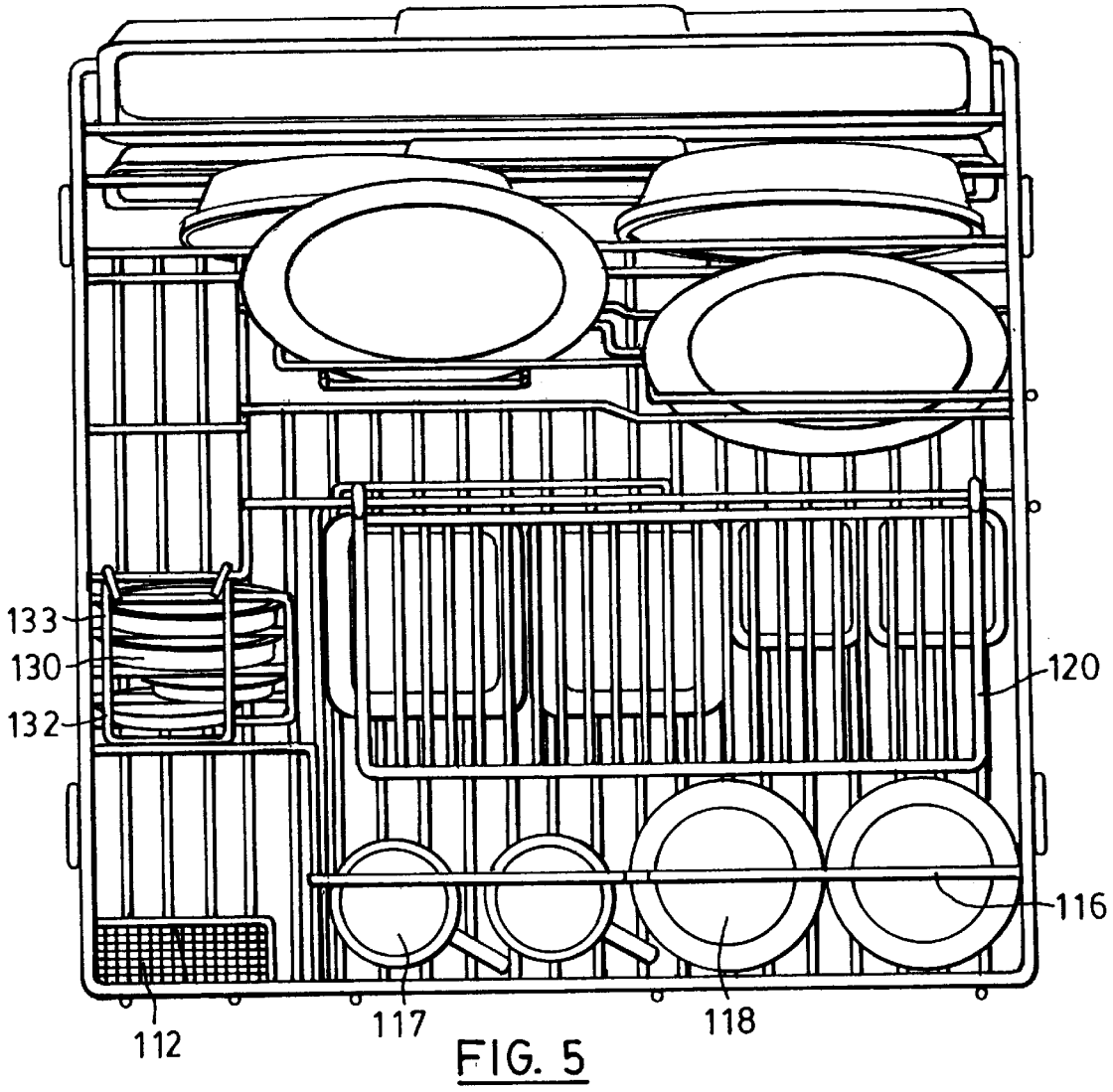
FIG. 5 is a plan view similar to FIG. 4, showing the basket in a closed configuration after being loaded with wares.
Figure 6:
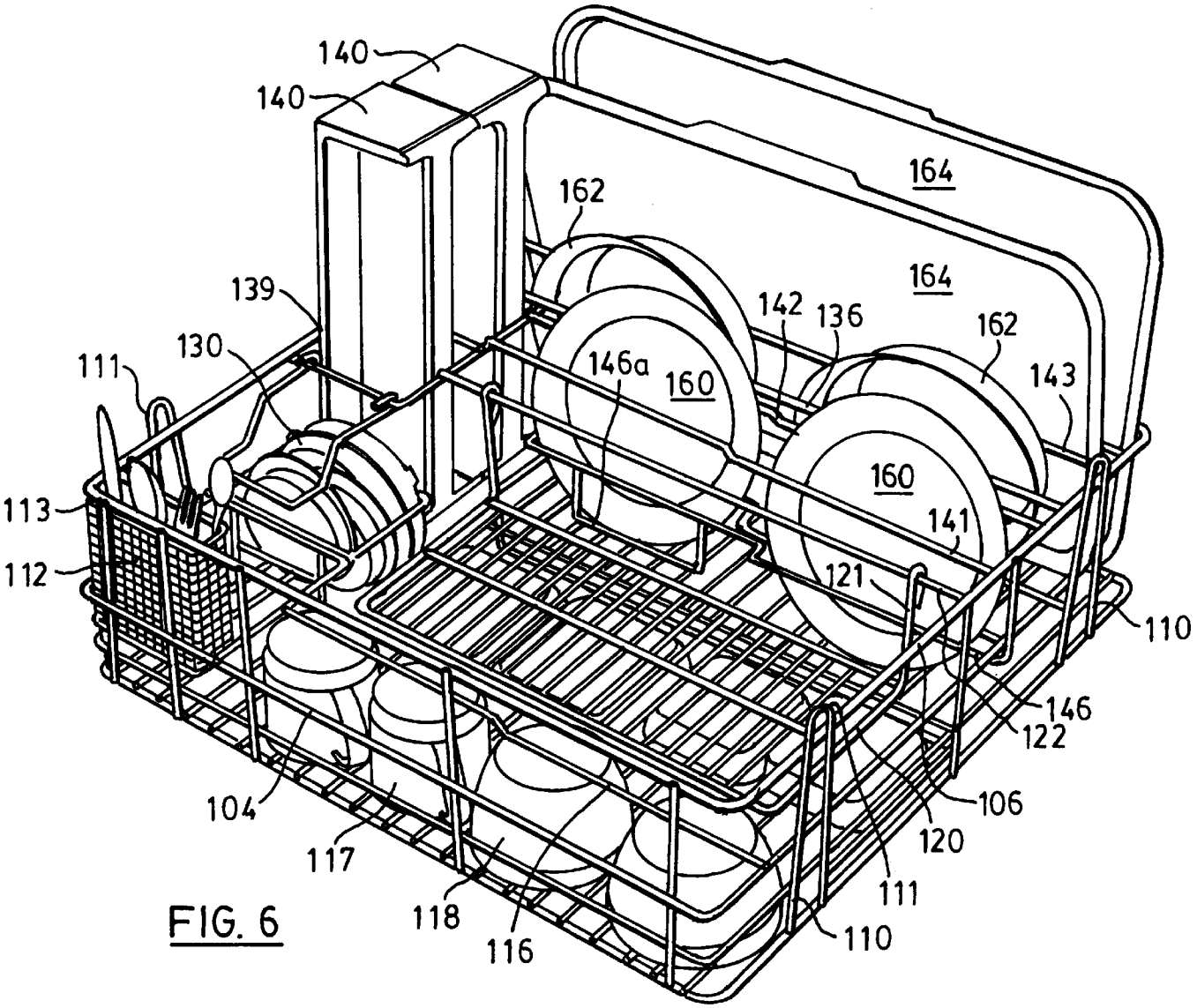
FIG. 6 is a perspective view of the basket of FIG. 5.

A first retention frame 120, as for the base, is formed from a parallel array of wires and includes two upstanding legs 121, best shown in FIG. 6, pivotally mounted around a cross member 122. FIGS. 2 and 6 30 show the retention member 120 in the closed position. FIG. 3 shows the retention frame swung to an open position, and as shown in FIG. 4, additional bowls are containers variously indicated at 124 in FIG. 4 can be covered and secured in position by pivoting the retention frame 120 back to the FIG. 6 position.

Immediately above the L-shaped member 114, there is a lid holding area 126 for holding lids and the like which have a relatively shallow depth. As best seen in FIGS. 2 and 4, a frame 128 is provided defining a number of parallel slots extending laterally for securing lids and the like, generally indicated at 130.

To ensure that the lids 130 are held in position, and in particular are not displaced by the force of water cleaning jets, a second retention frame 132 is provided. The frame 132 has legs 133 pivotally mounted to a fixed frame member 134. Again, FIGS. 3 and 4 show the retention frame 132 pivoted to an open position for loading or removal of the lids 130.

As shown in FIG. 2 and elsewhere, the frame member 134 is generally L-shaped and extends back to a further cross member 136 to define a rectangular opening divided into two approximately square openings by a dividing member 138. This defines two square openings 139 for receiving tray dividers 140, as shown in FIG. 6.

Behind the cross member 122, is a series of cross members identified as 141, 142, 143, and 144. Between the wires of cross members 141, 142, there is a pair of additional elements 146, 147. They extend in a horizontal plane approximately in the middle of the basket. As shown, the intermediate members 146, 147 are secured either to a further intermediate member 150 or to the right hand side 106 of the basket. The intermediate members 146, 147 define two slots 148, 149 for receiving and holding plates as detailed below. Additionally, the front of the intermediate member 146 includes an extension indicated at 146*a* extending downwardly.

Between the cross member 136 previously mentioned in relation to the square openings for the tray dividers, and the next rearmost cross member 143, a slot 152, for receiving plate covers is provided. The further intermediate member 150, here extending close to the bottom of the basket, but spaced therefrom, serves to ensure that tray covers are tilted forward, as shown in FIG. 6.

Finally, at the rearmost portion of the basket 100, the cross members 143, 144 define two slots 154, 156, for receiving trays. As best shown in FIG. 7, extending down from each of the cross members 144, 143 is a respective extension 143*a* and 144*a*. Additionally, extending from the extension 143*a* is a further extension 143*b*.Each of these extensions is a generally U-shaped wire element having vertical side legs and a horizontal portion.

Thus, in use, the basket 100 is loaded with cutlery 113 in container 112, and bowls and cups 117, 118 are slid under and retained by the retaining wire 116. Additional bowls 124 are retained in place by the first retention frame 120 and lids 130 are retained in place by the second retention frame 132. Tray dividers 140 are placed in the openings 139. Plates indicated at 160 are placed in the slots 148, 149. The form of the intermediate members 146, 147 serves to define two slots holding the plates at slightly different angles, and also the left hand plate 160 is held at its lower edge on the extension 146*a*. This is done to ensure full and thorough cleaning of the plates 160 and to ensure that water drains out of them.

A pair of plate covers 162 is placed in the slot 152, side by side, and as mentioned, the intermediate member 150 serves to angle these covers forward, again to ensure that they are adequately washed by washing jets coming from underneath and through the basket.

Finally, a pair of trays 164 is placed in the slots 154, 156. The various extension members 143*a*, 143*b* and 144*a* ensure that the rearmost tray 164 is held largely upright, while the forward most tray is angled more to the front of the basket 100, as shown in FIG. 7. This again is done to ensure that the trays 164 are held accurately and subject to thorough cleaning.

The basket 100, as loaded and shown in FIG. 6 is placed on the conveyor 14 and passes through the washing unit 16 and drying unit 18. The conveyors 14, 20 and 24, in known manner have an open mesh structure, to permit free passage of water and air. From there, the basket and wares pass through the cooling unit 22, where the wares are cooled. After the discharge station 26, the wares are unloaded from the basket 100 and placed on the loading table 50. In known manner this can include a conveyor assembly, where the tray, reassembled with the bowls, plates and other wares is passed along the line and progressively refilled with the prescribed food. The empty baskets 100 are returned along the third conveyor back to the input station 12, together with any rejected wares for further cleaning.

Reference will now be made to FIGS. 8, 9 and 10, which show a second embodiment of the basket according to the present invention. For simplicity and to avoid unnecessary duplication, like components are given the same reference numeral as in the first embodiment and their description is not repeated. This second embodiment is intended for sets of wares for airline use, and here shows two sets of wares that would be used for first class customers, i.e. where usually a relatively large number of wares are present and the tray and associated wares have relatively large dimensions, to take advantage of the additional space commonly available to first class passengers. For regular airline seating, the space is usually more limited, and hence the trays will be smaller and the number and size of related wares would be smaller, which can then enable a large number of sets of wares to be held in one basket. Thus, a single basket can be configured to hold four or more sets of wares.

Here, the second embodiment of the basket is generally indicated by the reference 200, and is largely symmetrical as between the left and right hand sides. Thus, on either side the basket 200 includes first and second insert containers 202, for holding cutlery. As best shown in FIG. 8, the base 102 is formed with a series of parallel wires running from front to back. Here, these wires essentially comprise a first group of wares 204 on either side of the basket and a second group of wares 206 in the center of the basket. The first group of wires are spaced apart at a relatively large distance and are intended to support relatively large wares, while the second group of wares 206, as shown, are intended to support relatively small wares, such as cups etc., and for this reason are more closely spaced.

On either side, there is a retention frame, here indicated at 210. As noted, the construction is essentially symmetrical, and is described further in relation to just one side of the basket 200, it being understood that the other side corresponds. In FIGS. 8 and 9, the left hand retention frame 210 is shown in a closed position, while the right had retention frame 210 is shown in an open position.

Each of the retention frames comprises legs 212, which in the closed position extend vertically downwardly, immediately inside the basket. The legs 212 are continuous with a wire that extends around the periphery of a central frame portion 214.

Extending from the innermost edge of each frame portion 214 is a first frame extension 216, which is shown in FIG. 9, is inclined slightly upwardly at its innermost edge. Extending further from this first frame extension 216 is a second frame extension 218 formed from narrower gauge wire, in known manner. These frame extensions 216, 218 are intended to assist in retaining larger wares in position, which are not present in this example.

Along the centerline of the basket 200, there is a first holding area 220 for relatively shallow cups and the like, and a second holding area 222 for larger cups or beakers, which, again as best shown in FIG. 9, has a taller frame around it, to securely hold the taller wares. The second holding area 222 is divided into four square segments by frame elements 224.

At the rear of the basket 200, similar to the first embodiment, there are two cross members 230 and 232 defining corresponding slots 231 and 233. Extending from the cross members 230, 232 are extension members 230*a* and 232*a*. Additionally, as best seen in FIG. 10, at least one additional extension member 232*b* is provided, extending forwardly from the rearwardly extending extension member 232*a*.

Thus, in use, this basket 200 would be loaded similarly to the first embodiment. Here, the basket 200 is shown loaded with two trays 240, and the wares are loaded generally symmetrical about a center line extending between the sides of the basket.

Thus, on each side there is a large bowl 242, large and small elongate dishes 243 and 244, and a round bowl 245. From each set, there is, within the first holding area 220 a cup 246, and within the second holding area 222 a pair of cups or beakers 247, these being indicated for the set located on the right hand side of FIG. 8. Cutlery, not shown, would be placed in the insert containers 202.

With the basket loaded, the retention frames 210 would be swung into the closed position, as shown, for the left hand retention frame in FIG. 8. The loaded basket 200 can then be placed on the conveyor at the input station 12 and passed through the apparatus 10, as detailed above. At the discharge station 26, it can be removed and unloaded, again as for the first embodiment.

The basket 200 includes an additional wire 250 on either side, approximately at the top of the basket 200, each of which defines a further slot 252. The purpose of these further slots 252 is to accommodate smaller trays. Thus, where smaller trays and utensils are provided, then four sets can be loaded into the basket. Two trays would be placed in the rearmost slots 231 and 233, and two additional trays in the slots 252. The slots 252 would be loaded with the trays after the retention frames 210 have been swung into the closed position. With the presence of smaller and/or lesser wares, four sets of wares can be loaded in the basket. Thus, the second holding area 222 is already configured to hold four cups or beakers, and if four slightly smaller cups are used, four such cups can be placed in the first holding area 220. This then enables four complete sets of equipment to be washed and dried simultaneously.

It will be appreciated that while a preferred embodiment of the present invention has been described, many variations are possible within the scope and spirit of the invention. For example, while the invention has been described utilizing a basket for keeping sets of wares together and for passing the sets of wares through the washing and drying units etc., this is not essential. A key concept behind the present invention is to retain sets of wares together and to refill the wares immediately for reuse, rather than store the wares, not in sets, for reuse at a later time.

Thus, it is conceivable that the conveyor system could be configured to take the wares through the washing and drying units and the cooling unit, without requiring a basket. To facilitate keeping the wares in sets, the various conveyors could, effectively, be divided into separate tracks, each track being intended for one particular type of ware, for example one track for plates, another for cups, another for bowls etc. It may well be that such technique would not keep the wares together in sets as exactly as the present invention, but this can be accommodated by providing greater flexibility at the discharge station 26 and keeping a larger stock of spare wares there, to accommodate any missing items or items that need to be returned for further washing. Such an arrangement may well enable the greater throughput of wares.

We claim:

1. A method of washing wares for food and filling the wares with food, the method comprising:

(1) receiving sets of soiled wares, each set comprising a plurality of wares intended to be used together for one individual;

(2) passing the wares through a washing and drying means, in which the wares are washed and dried;

(3) cooling the wares cooled down to a temperature low enough to permit immediate refilling of the wares with food; and (4) reassembling the wares into sets and refilling the wares with food, whereby each set is ready for delivery to an individual;

wherein steps (2), (3) and (4) are carried out substantially continuously and sequentially.

2. A method as claimed in claim 1, wherein, in steps (2) and (3) the wares are kept together in sets.

3. A method as claimed in claim 2, wherein each set of wares comprises a tray and other wares carried by the tray.

4. A method as claimed in claim 3, which includes providing a plurality of baskets, each of which is intended to hold at least one complete set of wares, wherein step (1) includes loading each set of wares into a basket, steps (2) and (3) comprise sequentially passing the baskets loaded with sets of wares through a washing and drying means and through a cooling means, and step (4) comprises removing each set of wares from the baskets and returning the baskets for reuse.

5. A method as claimed in claim 4, wherein each basket is adapted to hold two sets of wares, and wherein step (1) includes loading two sets of wares into each basket and step (4) includes unloading two sets of wares from each basket.

6. A method as claimed in claim 4, wherein each basket is adapted to hold four sets of wares, and wherein step (1) includes loading four sets of wares into each basket and step (4) includes unloading four sets of wares from each basket and reassembling each set of wares.

7. A method as claimed in claim 4, wherein each basket includes a first retention means for retaining food containers in position, the first retention means being moveable between open and closed positions, wherein step (1) includes placing the retention means in the open position, loading the basket with food containers and moving the retention means to the closed position and step (4) includes moving the first retention means to the open position and removing the food containers from the basket.

8. A method as claimed in claim 7, wherein the basket includes slots for trays, food containers and lids, wherein step (1) includes filling the slots with trays and food containers.

9. A method as claimed in claim 8, wherein the basket includes a lid holding area and second retention means for holding lids in position, the second retention means being movable between open and closed positions, wherein step (1) includes loading the lid holding area with lids with the second retention means in the open position and moving the second retention means into the closed position, and step (4) includes moving the second retention means to the open position and removing the lids from the lid holding area.

10. A method as claimed in claim 9, wherein each basket includes an insert container for cutlery, wherein step (1) includes loading the insert container with cutlery and step (4) includes removing the cutlery from the insert container.

11. A method as claimed in claim 10, wherein each basket includes a fixed retention member for retaining open containers, wherein step (1) includes sliding containers under the fixed retention member and step (4) includes sliding the containers out from under the fixed retention member and removing the containers from the basket.

12. A method as claimed in claim 4, which includes providing a substantially continuous conveyor means, including an input station at one point on the conveyor means and a discharge station at another point on the conveyor means, the washing and drying means and the cooling means being provided along the conveyor means, wherein step (1) comprises receiving sets of soiled wares at the input station, loading soiled wares into baskets at the input station and loading the baskets with the soiled wares onto the conveyor means, whereby the baskets are transported by the conveyor means through the washing and drying means and then through the cooling means, and wherein step (4) comprises receiving the baskets at the discharge station and removing and reassembling the sets of wares from the baskets and then returning the baskets along the conveyor means to the input station.

13. An apparatus for washing soiled wares and providing the wares ready for refilling and reuse, the apparatus comprising:

an input station for receiving soiled wares;

a discharge station for removing clean wares and reassembling wares into sets of wares;

a substantially continuous conveyor means extending between the input station and the discharge station and back from the discharge station to the input station;

a washing and drying means provided on the conveyor means; and a cooling means provided on the conveyor means, the arrangement being such that baskets containing sets of wares are sequentially subject to washing, drying and cooling between the input and discharge stations.

14. An apparatus as claimed in claim 13, wherein the washing and drying means comprises a separate washing unit and a separate drying unit.

15. An apparatus as claimed in claim 14, wherein the input station comprises two input locations on either side of a conveyor.

16. An apparatus as claimed in claim 15, wherein the conveyor means is adapted to convey baskets, each holding at least one set of wares, wherein the basket and the conveyor means are adapted to permit free flow of water for washing and air for drying.

* * * * *